US009230493B2

(12) United States Patent
Zhang

(10) Patent No.: US 9,230,493 B2
(45) Date of Patent: Jan. 5, 2016

(54) LCD DEVICE DRIVER CIRCUIT, DRIVING METHOD, AND LCD DEVICE

(71) Applicant: SHENZHEN CHINA STAR OPTOELECTRONICS TECHNOLOGY CO., LTD., Shenzhen (CN)

(72) Inventor: Xianming Zhang, Shenzhen (CN)

( * ) Notice: Subject to any disclaimer, the term of this patent is extended or adjusted under 35 U.S.C. 154(b) by 291 days.

(21) Appl. No.: 13/809,495

(22) PCT Filed: Jan. 6, 2013

(86) PCT No.: PCT/CN2013/070101
§ 371 (c)(1),
(2) Date: Jan. 10, 2013

(87) PCT Pub. No.: WO2014/101313
PCT Pub. Date: Jul. 3, 2014

(65) Prior Publication Data

US 2014/0184482 A1 Jul. 3, 2014

(51) Int. Cl.
*G09G 3/36* (2006.01)
*G09G 3/34* (2006.01)

(52) U.S. Cl.
CPC ..... *G09G 3/36* (2013.01); *G09G 3/3406* (2013.01); *G09G 2320/0247* (2013.01); *G09G 2330/00* (2013.01); *G09G 2330/026* (2013.01); *G09G 2330/027* (2013.01)

(58) Field of Classification Search
CPC ..... G09G 3/36; G09G 3/3406; G09G 2320/0247; G09G 2330/00; G09G 2330/026; G09G 2330/027; G09G 2320/0252
USPC ..... 345/102, 87
See application file for complete search history.

(56) References Cited

U.S. PATENT DOCUMENTS 5,572,735 A * 11/1996 Tanikawa ..... G06F 1/3218 320/166
6,927,755 B2 * 8/2005 Chang ..... G09G 3/3677 345/101
7,449,839 B1 11/2008 Chen
7,545,106 B2 * 6/2009 Ger et al. ..... 315/307
2005/0275356 A1 * 12/2005 Faccin et al. ..... 315/307
2006/0267906 A1 * 11/2006 Shie ..... G09G 3/3696 345/98
2011/0074308 A1 * 3/2011 Liu et al. ..... 315/287

(Continued)

FOREIGN PATENT DOCUMENTS

CN 2516996 Y 10/2002
CN 1447306 A 10/2003

(Continued)

OTHER PUBLICATIONS

English Language Machine Translation of JP-2011-191494.*

(Continued)

*Primary Examiner* — Jason Mandeville

(57) ABSTRACT

A driver circuit of a liquid crystal display (LCD) device includes a drive line driving a lightbar of the LCD device. A discharge module and a switch module are in series connection between the drive line and a ground end of the LCD device driver circuit in sequence; a starting signal sent by the LCD device is coupled to the switch module. When the starting signal is an OFF signal, the switch module is turned on, and when the starting signal is an ON signal, the switch module is turned off.

14 Claims, 3 Drawing Sheets

(56) References Cited

U.S. PATENT DOCUMENTS

| | | | | |
|---|---|---|---|---|
| 2011/0181573 | A1* | 7/2011 | Lee | 345/211 |
| 2013/0069925 | A1* | 3/2013 | Lin et al. | 345/211 |
| 2014/0009455 | A1* | 1/2014 | Li | G09G 3/3406 345/212 |
| 2014/0327860 | A1* | 11/2014 | Cao | H05B 33/08 349/69 |

FOREIGN PATENT DOCUMENTS

| | | | |
|---|---|---|---|
| CN | 1870114 | A | 11/2006 |
| CN | 101101385 | A | 1/2008 |
| CN | 102136257 | A | 7/2011 |
| CN | 102306485 | A | 1/2012 |
| CN | 102522063 | A | 6/2012 |
| CN | 102842292 | A | 12/2012 |
| CN | 202602274 | U | 12/2012 |
| JP | 2011191494 | A * | 9/2011 |

OTHER PUBLICATIONS

Wang Chao, the International Searching Authority written comments, Sep. 2013, CN.

* cited by examiner

LCD DEVICE DRIVER CIRCUIT, DRIVING METHOD, AND LCD DEVICE

TECHNICAL FIELD

This application is at national stage application of PCT application PCT/CN2013/070101 filed on Jan. 6, 2013, which is based on and claims priority to Chinese patent application 201210589520.1 filed on Dec. 29, 2012 in China. The entirety of each of the above-mentioned applications is hereby incorporated by reference herein in its entirety.

The present disclosure relates to the field of liquid crystal displays (LCDs), and more particularly to as driver circuit of an LCD device, a driving method, and an LCD device.

BACKGROUND

A liquid crystal display (LCD) device includes a driver circuit of an LCD device. The driver circuit of the LCD device includes a lightbar providing a light source for the LCD device and a driver module driving the lightbar. The driver module is connected to the lightbar by a drive line, and an electrolytic capacitor is connected to the drive line. When the LCD device is quickly powered on or powered off, the electrolytic capacitor may not he quickly and completely discharged, resulting in a flicker when the LCD device is restarted. As shown in FIG. 1, to solve the problem mentioned above, discharge resistors (R1 and R2) are generally arranged in parallel between the drive line Vout and a ground end CiND of an entire circuit (namely arranged in parallel at two ends of the electrolytic capacitor C) in the prior art. However, to completely reduce the flicker during power-on or power-off more resistors are needed to be arranged in parallel in the technical scheme. With an increase of a number of resistors, comes an increase in power use of the resistors, resulting in efficiency reduction of the LCD device.

SUMMARY

In view of the above-described problems, the aim of the present disclosure is to provide a driver circuit of a liquid crystal display (LCD) device, a driving method, and an LCD device capable of solving the problem of a flicker during power-on or power-off and improving work efficiency of the LCD device.

The aim of the present disclosure is achieved by the following technical scheme.

A driver circuit of an LCD device comprises a drive line driving as lightbar of the LCD device. A discharge module and a switch module are in series connection between the drive line and a ground end of the LCD device driver circuit in sequence, as starting signal sent by the LCD device, is coupled to the switch module.

When the starting signal is an OFF signal, the switch module is on, when the starting signal is an ON signal, the switch module is off.

Furthermore, the switch module comprises a first controllable switch, which is in series connection between the discharge module and the ground end of the LCD device driver circuit, and a monitoring unit coupled to a control end of the first controllable switch.

The monitoring unit drives the first controllable switch to turn on when the LCD device sends the OFF signal, and the monitoring unit drives the first controllable switch to turn off when the LCD device sends the ON signal. This is a circuit which uses the controllable switch to control the discharge of the discharge module. The first controllable switch is on when the LCD device is powered off, and the capacitor is discharged by the discharge module. After the LCD device is powered on, the first controllable switch is off, the discharge circuit of the discharge module is shut off, the discharge module is not operated, and there is no additional energy consumption.

Furthermore, the monitoring unit comprises a second controllable switch coupled to the ground end of the LCD device driver circuit, a divider resistor coupled to the second controllable switch, and a reference voltage coupled to the divider resistor. A control end of the second controllable switch is coupled to the starting signal.

The OFF signal sent by the LCD device is a low-level signal, and the ON signal sent by the LCD device is a high-level signal. The first controllable switch and the second controllable switch are driven to turn on by the low-level signal. This is a first circuit structure of the monitoring unit. Because both the first controllable switch and the second controllable switch are driven to turn on by the low-level signal, universalization rate of the device is increased by using a controllable switch (such as metal-oxide-semiconductor field-effect transistor (MOSFET)) of a same type. In addition, if actuating logics of the two controllable switches are opposite, wrong connection may exist in a process of production. Thus, by using the controllable switches of a same actuating logic, human error may be effectively avoided, to facilitate production and increase product yield.

Furthermore, the monitoring. unit comprises a divider resistor coupled to the ground end of the LCD device driver circuit, a second controllable switch coupled to the divider resistor, and a reference voltage coupled to the second controllable switch. A control end of the second controllable switch is coupled to the starting signal.

The OFF signal sent by the LCD device is a low-level signal, and the ON signal sent by the LCD device is a high-level signal. The first controllable switch is driven to turn on by the low-level signal, and the second controllable switch is driven to turn on by the high-level signal. This is a second circuit structure of the monitoring unit.

Furthermore, the monitoring unit comprises a divider resistor coupled to the ground end of the LCD device driver circuit, a second controllable switch coupled to the divider resistor, and a reference voltage coupled to the second controllable switch. A control end of the second controllable switch is coupled to the starting signal by a logic inverter.

The OFF signal sent by the LCD device is a low-level signal, and the ON signal sent by the LCD device is a high-level signal. The first controllable switch and the second controllable switch are driven to turn on by the high-level signal. This is a third circuit structure of the monitoring unit. Because both the first controllable switch and the second controllable switch are driven to turn on by the high-level signal, universalization rate of the device is increased by using a controllable switch such as metal-oxide-semiconductor field-effect transistor (MOSFET)) of a same type. In addition, if actuating logics of the two controllable switches are opposite, t wrong connection may exist in a process of production. Thus, by using the controllable switches of a same actuating logic, human error may be effectively avoided, to facilitate production and increase product yield.

Furthermore, the discharge module comprises a plurality of discharge resistors that are arranged in parallel, a first end of each discharge resistor is connected to the drive line, and a second end of the discharge resistor is coupled to the switch module. This is a specific circuit structure of the discharge module. The resistor has advantages of low cost, increase of discharge power by parallel connection, and convenient development, Furthermore, resistance value of the discharge resistor is 100 KΩ. This is a specific type of the discharge resistor.

A driving method of a driver circuit of an LCD device comprises steps:

A: connecting a discharge module and a switch module in series between a drive line and a ground end of the LCD device driver circuit in sequence; and B: controlling, the switch module to turn on when the LCD device driver circuit is powered off, and controlling the switch module to turn off when the LCD device driver circuit is powered on.

Furthermore, in the step A, the switch module comprises a first controllable switch in series connection between the discharge module and the ground end of the LCD device driver circuit, and a monitoring unit coupled to a control end of the first controllable switch.

In the step B, when the LCD device driver circuit is powered off, the monitoring unit drives the first controllable switch to turn on, when the LCD device driver circuit is powered on, the monitoring unit drives the first controllable switch to turn off. This is a circuit which uses the controllable switch to control the discharge of the discharge module. The first controllable switch is on when the LCD device is powered off, and the capacitor is discharged by the discharge module. After the LCD device is powered on, the first controllable switch is off, the discharge circuit of the discharge module is shut off, the discharge module is not operated, and there is no additional energy consumption.

An LCD device comprises a driver circuit of the LCD device of the present disclosure.

The inventor finds by research that in the prior art, to quickly and completely discharge a capacitor when the LCD device is powered off, a plurality of resistors are needed to be arranged in parallel for discharge. However, the resistors are still in art operating state when the LCD device normally displays, and continuously consume power, which increases power consumption and reduces work efficiency of the LCD device. To improve efficiency, a number of resistors is reduced. However, discharge time of the capacitor is increased if a number of resistors is reduced, which results in decreasing of speed. of the discharge. Particularly, under a condition that a plurality of output electrolytic capacitors are arranged in parallel, flicker still exists when the LCD device is quickly powered on. In the situation, in the present disclosure, the discharge module and the switch module are in series connection between the drive line and the ground end of the LCD device driver circuit in sequence. The switch module is turned on when the LCD device outputs the OFF signal to form a discharge circuit, and the capacitor is discharged by the discharge module. The switch module is turned off when the LCD device outputs the ON signal, and then the discharge circuit of the discharge module is shut off. The discharge module is not used when the LCD device normally operates. Thus, the power is not consumed, and the power consumption of the ON state of the LCD device is not increased. To accelerate the discharge speed of the capacitor during power-off, the power of the discharge module may be increased by a scheme such as connecting more resistors in parallel, etc. Because the discharge module only used in the power-off state, the own power of the discharge module may not affect the work efficiency of the LCD device. Thus, the flicker during power-on is substantially reduced while the work efficiency of the LCD device is not reduced.

DETAILED DESCRIPTION

The present disclosure provides a liquid crystal display (LCD) device, and the LCD device comprises a driver circuit of the LCD device.

Figure 1:
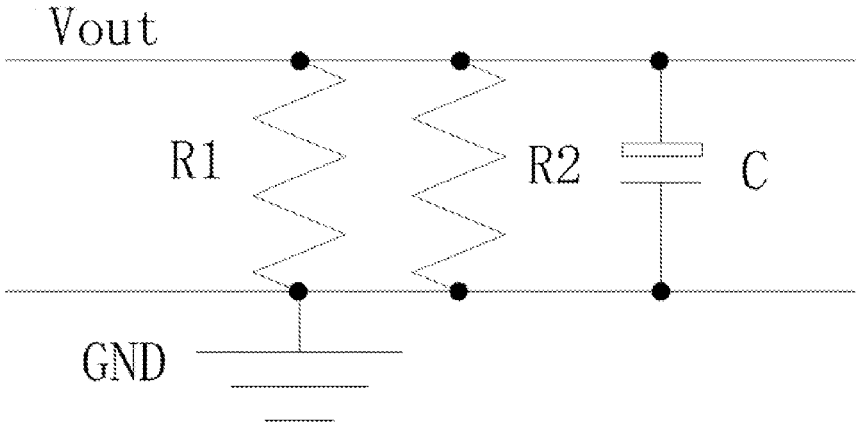
FIG. 1 PRIOR ART
FIG. 1 is a schematic diagram of a prior art.
Figure 2:
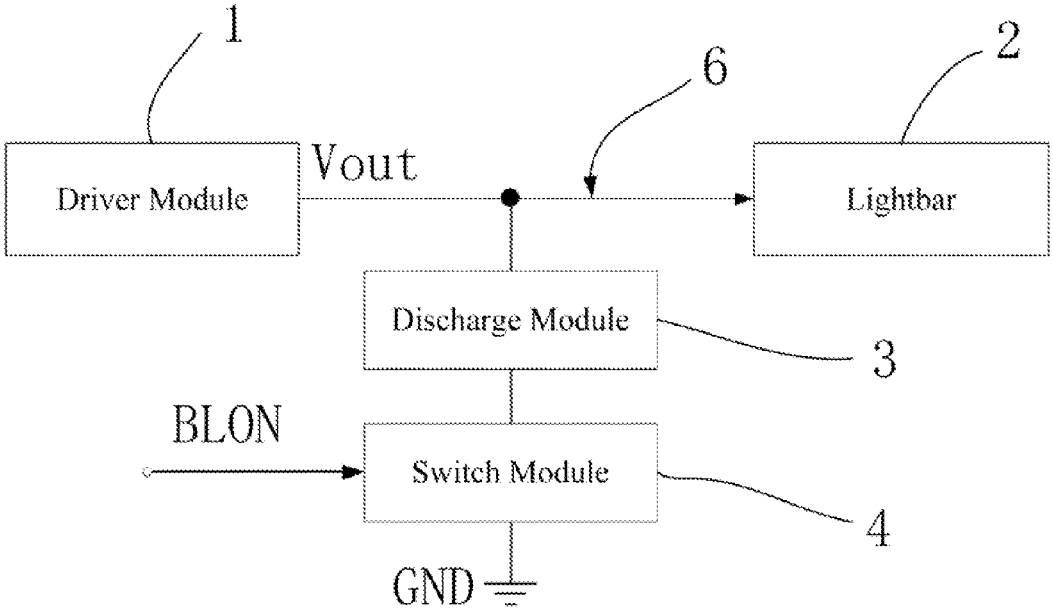
FIG. 2 is a schematic block diagram of the present disclosure.

As shown in FIG. 2, the driver circuit of the LCD device comprises a drive line 6 driving a lightbar 2 of the LCD device, a discharge module 3 and a switch module 4 are in series connection between the drive line 6 and a ground end of the driver circuit of the LCD device in sequence. A starting signal sent by the LCD device is coupled to the switch module 4.

When the starting signal is an OFF signal, the switch module 4 is on. When the starting signal is an ON signal, the switch module 4 is off.

The inventor finds by research that in the prior art, to quickly and completely discharge a capacitor when the LCD device is powered off, a plurality of resistors are needed to be arranged in parallel for discharge. However, the resistors are still in an operating state when the LCD device normally displays, and the resistors continuously consume power, which increases power consumption and reduces work efficiency of the LCD device. To improve the work efficiency, a number of resistors is reduced. However, discharge time of the capacitor increases if the number of resistors is reduced, which results in decreasing of speed of the discharge. Particularly, under a condition that a plurality of output electrolytic capacitors are arranged in parallel, flicker still exists when the LCD device is quickly powered on. In the situation, in the present disclosure, the discharge module 3 and the switch module 4 are in series connection between the drive line 6 and the ground end of the LCD device driver circuit in sequence. The switch module 4 is turned on when the LCD device outputs the OFF signal to form a discharge circuit, and the capacitor is discharged by the discharge module 3. The switch module 4 is turned off when the LCD device outputs the ON signal, and then the discharge circuit of the discharge module 3 is shut off. The discharge module 3 is not used when the LCD device normally operates. Thus, power is not consumed, and the power consumption of the ON state of the LCD device is not increased. To accelerate the discharge speed of the capacitor during power-off, the power of the discharge module 3 may be increased by a scheme such as connecting more resistors in parallel. Because the discharge module 3 is only used in the power-off state, the own power of the discharge module 3 may not affect the work efficiency of the LCD device. Thus, the flicker during power-on is substantially reduced while, the work efficiency of the LCD device is not reduced.

The present disclosure is further described in detail in accordance with the figures and the exemplary examples.

EXAMPLE 1

Figure 3:
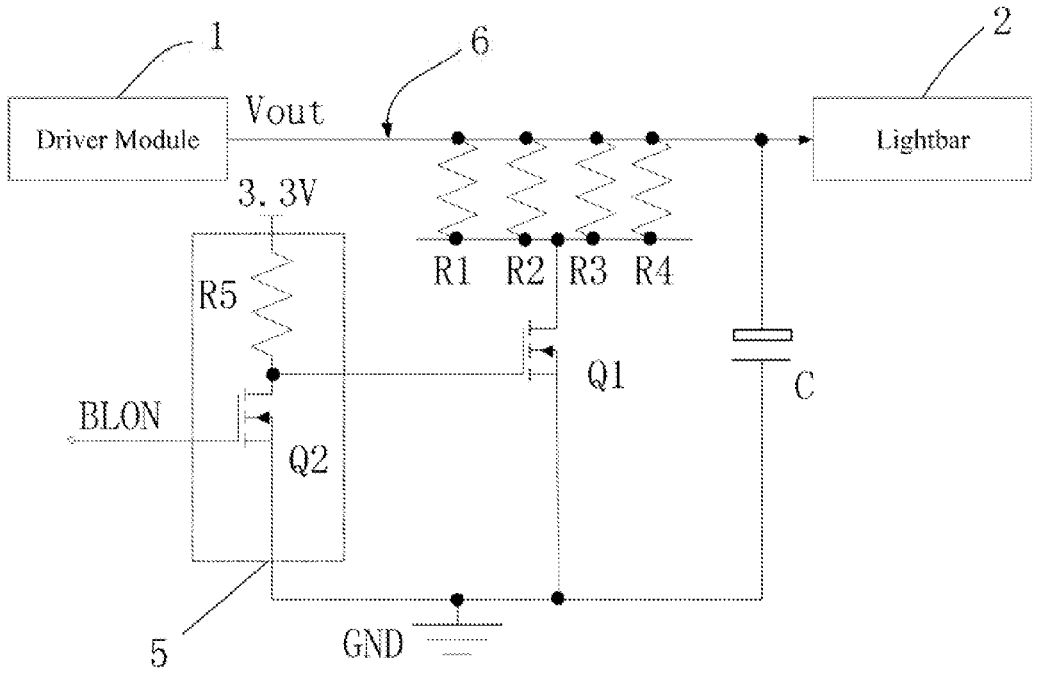
FIG. 3 is a schematic diagram of a first example of the present disclosure.

As shown in FIG. 2 and FIG. 3, a driver circuit of an LCD device comprises a backlight module. The backlight module comprises a lightbar 2 and a driver module 1 driving the lightbar 2. The driver module 1 is connected to the lightbar 2 by a drive line 6, a discharge module 3 and a switch module 4 are in series connection between the drive line 6 and a ground end of the LCD device driver circuit in sequence, and an electrolytic capacitor C is arranged between the drive line 6 and a ground end of the LCD device driver circuit. A starting signal sent by the LCD device is coupled to the switch module 4.

The discharge module 3 comprises a plurality of discharge resistors that are arranged in parallel (R1-R4 as shown in the FIG. 3), resistance value of each discharge resistor is 100 KΩ, a first end of the discharge resistor is connected with the drive line 6, and a second end of the discharge resistor is coupled to the switch module 4. The resistor used by the discharge module 3 has advantages of low cost, increase, of discharge power by parallel connection, and convenient development.

The switch module 4 comprises a first controllable switch Q1, which is in series connection between the discharge module 3 and the ground end GND of the LCD device driver circuit, and a monitoring unit 5 coupled to a control end of the first controllable switch Q1. The monitoring unit 5 comprises a second controllable switch Q2 coupled to the ground end GND of the LCD device driver circuit, a divider resistor R5 coupled to the second controllable switch Q2, and a reference voltage coupled to the divider resistor R5. A control end of the second controllable switch Q2 is coupled to the starting signal.

An OFF signal sent by the LCD device is a low-level signal (logic 0), and an ON signal sent by the LCD device is a high-level signal (logic 1). The first controllable switch Q1 and the second controllable switch Q2 are driven to turn on by the low-level signal.

This is a specific circuit structure of a first switch module 4. The first controllable switch Q1 is on when the LCD device is powered off, and the capacitor is discharged by the discharge module 3. After the LCD device is powered on, the first controllable switch Q1 is off, the discharge circuit of the discharge module 3 is shut off, the discharge module 3 is not operated, and there is no additional energy consumption. In the example, because both the first controllable switch and the second controllable switch (Q1, Q2) are driven to turn on by the low-level signal, universalization rate of the device is increased by using a controllable switch (such as metal-oxide-semiconductor field-effect transistor (MOSFET)) of a same type. In addition, if actuating logics of the two controllable switches are opposite, wrong connection may exist in a process of production. Thus, by using the controllable switches of a same actuating logic, human error may be effectively avoided, to facilitate production and increase product yield.

EXAMPLE 2

Figure 4:
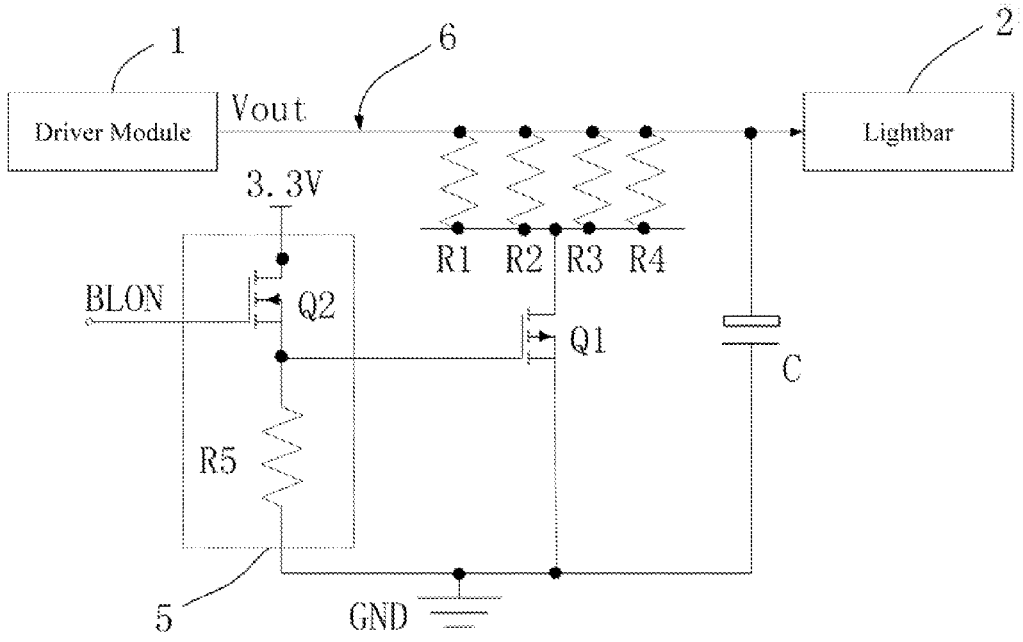
FIG. 4 is a schematic diagram of a second example of the present disclosure.

As shown in FIG. 2 and FIG. 4, a driver circuit of an LCD device comprises a backlight module. The backlight module comprises a lightbar 2 and a driver module 1 driving the lightbar 2. The driver module 1 is connected to the lightbar 2 by a drive line 6, a discharge module 3 and a switch module 4 are in series connection between the drive line 6 and a ground end of the LCD device driver circuit in sequence, and an electrolytic capacitor C is arranged between the drive line 6 and as ground end of the LCD device driver circuit. A starting signal is sent by the LCD device is coupled to the switch module 4.

The discharge module 3 comprises a plurality of discharge resistors that are arranged in parallel (R1-R4 as shown In the FIG. 4), resistance value of each discharge resistor is 100 KΩ, a first end of the discharge resistor is connected with the drive line 6, and a second end of the discharge resistor is coupled to the switch module 4. The resistor used by the discharge module 3 has advantages of low cost, increase of discharge power by parallel connection, and convenient development.

The switch module 4 comprises a first controllable switch Q1 which is in series connection between the discharge module 3 and the ground end GND of the LCD device driver circuit, and a monitoring unit 5 coupled to a control end of the first controllable switch Q1. The monitoring unit 5 comprises a divider resistor R5 coupled to the ground end GND of the LCD device driver circuit, a second controllable switch Q2 coupled to the divider resistor R5, and as reference voltage coupled to the second controllable switch Q2. A control end of the second controllable switch Q2 is coupled to the starting signal.

An OFF signal sent by the LCD device is a low-level signal, and an ON signal sent by the LCD device is a high-level signal. The first controllable switch Q1 is driven to be turn on by the low-level signal, and the second controllable switch Q2 is driven to be turn on by the high-level signal.

This is a second specific circuit structure of the switch module 4. The first controllable. switch Q1 is on when the LCD device is powered off, and the capacitor is discharged by the discharge module 3. After the LCD device is powered on, the first controllable switch Q1 is off, the discharge circuit of the discharge module 3 is shut off, the discharge module 3 is not operated, and there is no additional energy consumption.

EXAMPLE 3

Figure 5:
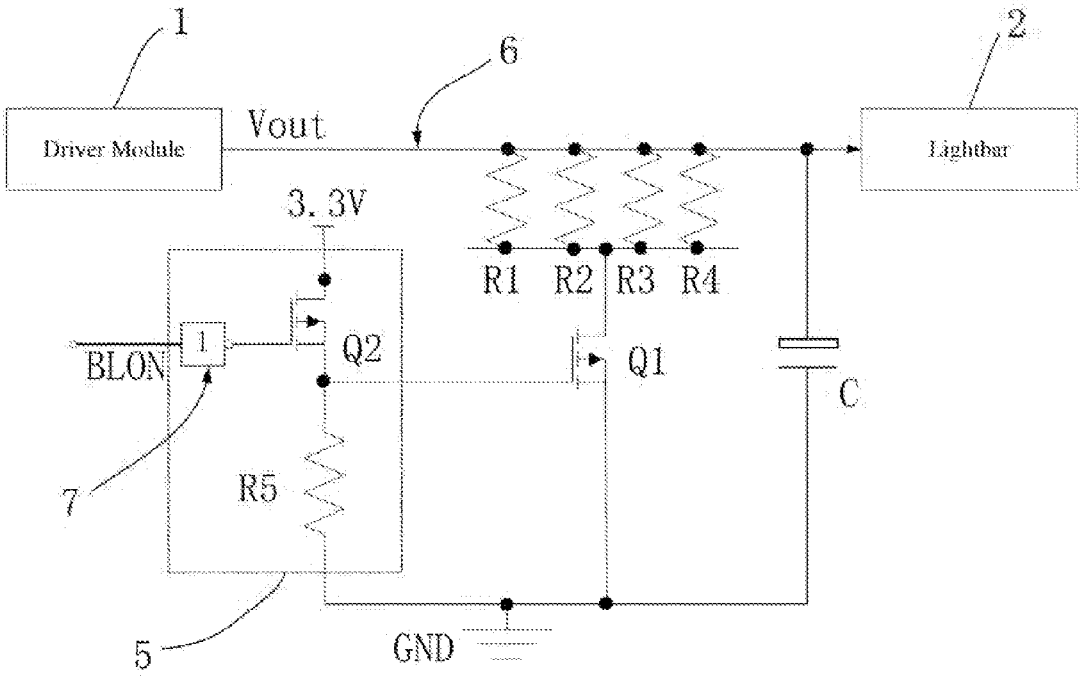
FIG. 5 is a schematic diagram of a third example of the present disclosure.
Figure 6:
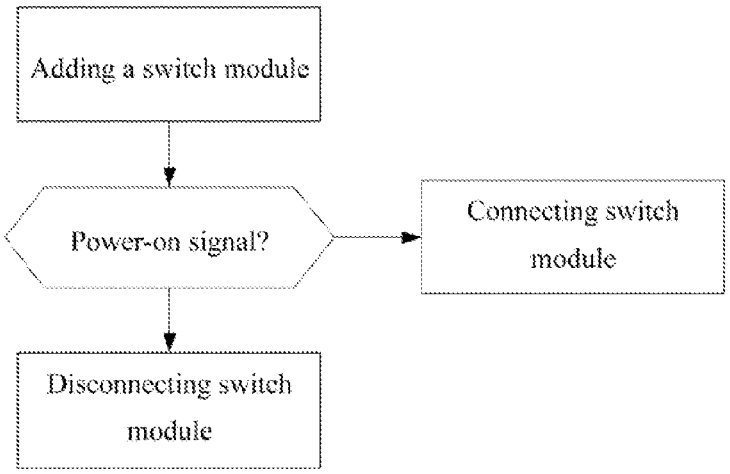
FIG. 6 is a schematic diagram of a method of the present disclosure.

As shown in FIG, 2 and FIG. 5, a driver circuit of an LCD device comprises a backlight module. The backlight module comprises a lightbar 2 and a driver module 1 driving the lightbar 2. The driver module 1 is connected to the lightbar 2 by a drive line 6, a discharge module 3 and a switch module 4 are in series connection between the drive tine 6 and a ground end of the LCD device driver circuit in sequence, and an electrolytic capacitor C is arranged between the drive line 6 and a ground end of the LCD device driver circuit. A starting signal sent by the LCD device is coupled to the switch module 4.

The discharge module 3 comprises a plurality of discharge resistors that are arranged. in parallel (R1-R4 as shown in the FIG. 5), resistance value of each discharge resistor is 100 KΩ, the first end of the discharge resistor is connected with the drive line 6, and the second end of the discharge resistor is coupled to the switch module 4. The resistor used by the discharge module 3 has advantages of low cost, increase of discharge power by parallel connection, and convenient development.

The switch module 4 comprises a first controllable switch Q1, which is in series connection between the discharge module 3 and the ground end GND of the LCD device driver circuit, and a monitoring unit 5 coupled to a control end of the first controllable switch Q1. The monitoring unit 5 comprises a divider resistor R5 coupled to the ground end GND of the LCD device driver circuit, a second controllable switch Q2 coupled to the divider resistor R5, and a reference voltage coupled to the second controllable switch Q2. A control end of the second controllable switch Q2 is coupled to the starting signal by a logic inverter 7.

An OFF signal sent by the LCD device is a low-level signal, and an ON signal sent by the LCD device is a high-level signal. The first controllable switch Q1 and the second controllable switch Q2 are driven to turn on by the high-level signal.

This is a third specific circuit structure of the switch module 4. The first controllable switch Q1 is on when the LCD device is powered off, and the capacitor is discharged by the discharge module 3. After the LCD device is powered on, the first controllable switch Q1 is off, the discharge circuit of the discharge module 3 is shut off, the discharge module 3 is not operated, and there is no additional energy consumption, In the example, because both the first controllable switch and the second controllable switch (Q1 and Q2) are driven to turn on by the high-level signal, universalization rate of the device is increased by using a controllable switch (such as metal-oxide-semiconductor field-effect transistor (MOSFET)) of a same type. In addition, if actuating logics of the two controllable switches are opposite, wrong connection may exist in a process of production. Thus, by using the controllable switches of a same actuating logic, human error may be effectively avoided, to facilitate production and increase product yield.

EXAMPLE 4

As shown in FIG. 2 and FIG, 6, the present disclosure further provides a driving method of an LCD device driver circuit, comprising steps:

A: connecting a discharge module 3 and a switch module 4 in series between a drive line 6 and a ground end GND of the LCD device driver circuit in sequence;

B: controlling the switch module 4 to turn on when the LCD device driver circuit is powered off, and controlling the switch module 4 to turn off when the LCD device driver circuit is powered on.

In the step A, the switch module 4 comprises a first controllable switch Q1, which is in series connection between the discharge module 3 and the ground end GND of the LCD device driver circuit, and a monitoring unit 5 coupled to a control end of the first controllable switch Q1.

In the step B, when the driver circuit of the LCD device is powered off, the monitoring unit 5 drives the first controllable switch Q1 to turn on, when the LCD device driver circuit is powered on, the monitoring, unit 5 drives the first controllable switch Q1 to run off. This is a circuit which uses the controllable switch to control discharge of the discharge module 3. The first controllable switch Q1 is on when the LCD device is powered off, and the capacitor is discharged by the discharge module. After the LCD device is powered on, the first controllable switch Q1 is off, the discharge circuit of the discharge module 3 is shut off, the discharge module 3 is not operated, and there is no additional energy consumption.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

I claim:

1. A driver circuit of a liquid crystal display (LCD) device, comprising:

a drive line driving a lightbar of the LCD device;

wherein a discharge module and a switch module are in series connection between the drive line and a ground end of the LCD device driver circuit in sequence, a starting signal sent by the LCD device is coupled to the switch module;

wherein a capacitor is in parallel connection to the discharge module and the switch module between the drive line and the ground end of the LCD device driver circuit, the capacitor further being connected to the drive line between the discharge module and the lightbar of the LCD device;

wherein when the starting signal is an OFF signal, the switch module is turned on, and when the starting signal is an ON signal, the switch module is turned off, wherein the discharge module is a plurality of discharge resistors that are connected in parallel, a first end of each of the discharge resistors is directly connected to the drive line, and a second end of each of the discharge resistors is coupled to a same terminal of the switch module, the discharge module discharging the capacitor in response to the OFF signal.

2. The driver circuit of the liquid crystal display (LCD) device of claim 1, wherein the switch module comprises a first controllable switch in series connection between the discharge module and the ground end of the LCD device driver circuit, and a monitoring unit coupled to a control end of the first controllable switch;

wherein the monitoring unit drives the first controllable switch to be on when the LCD device sends the OFF signal, and the monitoring unit drives the first controllable switch to be off when the LCD device sends the ON signal.

3. The driver circuit of the liquid crystal display (LCD) device of claim 2, wherein the monitoring unit comprises a second controllable switch coupled to the ground end of the LCD device driver circuit, a divider resistor coupled to the second controllable switch, and a reference voltage coupled to the divider resistor; a control end of the second controllable switch is coupled to the starting signal;

wherein the OFF signal sent by the LCD device is a low-level signal, and the ON signal sent by the LCD device is a high-level signal; the first controllable switch and the second controllable switch are driven to turn on by the low-level signal.

4. The driver circuit of the liquid crystal display (LCD) device of claim 2, wherein the monitoring unit comprises a divider resistor coupled to the ground end of the LCD device driver circuit, a second controllable switch coupled to the divider resistor, and a reference voltage coupled to the second controllable switch; a control end of the second controllable switch is coupled to the starting signal;

wherein the OFF signal sent by the LCD device is a low-level signal, and the ON signal output by the LCD device is a high-level signal; the first controllable switch is driven to turn on by the low-level signal, and the second controllable switch is driven to turn on by the high-level signal.

5. The driver circuit of the liquid crystal display (LCD) device of claim 2, wherein the monitoring unit comprises a divider resistor coupled to the ground end of the LCD device driver circuit, a second controllable switch coupled to the divider resistor, and a reference voltage coupled to the second controllable switch; a control end of the second controllable switch is coupled to the starting signal by a logic inverter;

wherein the OFF signal sent by the LCD device is a low-level signal, and the ON signal sent by the LCD device is a high-level signal; the first controllable switch and the second controllable switch are driven to turn on by the high-level signal.

6. The driver circuit of the liquid crystal display (LCD) device of claim 1, wherein resistance value of the discharge resistor is a 100 KΩ.

7. A driving method of a driver circuit of a liquid crystal display (LCD) device, comprising:

A: connecting a discharge module and a switch module in series between a drive line and a ground end of an LCD device driver circuit in sequence, wherein the discharge module is a plurality of discharge resistors that are connected in parallel, a first end of each of the discharge resistors is directly connected to the drive line, and a second end of each of the discharge resistors is coupled to a same terminal of the switch module, wherein a capacitor is in parallel connection to the discharge module and the switch module between the drive line and the ground end of the LCD device driver circuit, the capacitor further being connected to the drive line between the discharge module and the lightbar of the LCD device, the discharge module discharging the capacitor in response to the OFF signal; and B: controlling the switch module to turn on when the LCD device driver circuit is powered off, and controlling the switch module to turn off when the LCD device driver circuit is powered on.

8. The driving method of the driver circuit of the liquid crystal display (LCD) device of claim 7, wherein in the step A, the switch module comprises a first controllable switch in series connection between the discharge module and the ground end of the LCD device driver circuit, and a monitoring unit coupled to a control end of the first controllable switch;

in the step B, when the LCD device driver circuit is powered off, the monitoring unit drives the first controllable switch to turn on; when the LCD device driver circuit is powered on, the monitoring unit drives the first controllable switch to turn off.

9. A liquid crystal display (LCD) device, comprising:

an LCD device driver circuit;

wherein the LCD device driver circuit comprises a drive line driving a lightbar of the LCD device, a discharge module and a switch module are in series connection between the drive line and a ground end of the LCD device driver circuit in sequence; a starting signal sent by the LCD device is coupled to the switch module;

wherein a capacitor is in parallel connection to the discharge module and the switch module between the drive line and the ground end of the LCD device driver circuit, the capacitor further being connected to the drive line between the discharge module and the lightbar of the LCD device;

wherein when the starting signal is an OFF signal, the switch module is turned on, and when the starting signal is an ON signal, the switch module is turned off, wherein the discharge module is a plurality of discharge resistors that are connected in parallel, a first end of each of the discharge resistors is directly connected to the drive line, and a second end of each of the discharge resistors is coupled to a same terminal of the switch module, the discharge module discharging the capacitor in response to the OFF signal.

10. The liquid crystal display (LCD) device of claim 9, wherein the switch module comprises a first controllable switch in series connection between the discharge module and the ground end of the LCD device driver circuit, and a monitoring unit coupled to a control end of the first controllable switch;

wherein the monitoring unit drives the first controllable switch to be on when the LCD device sends the OFF signal, and the monitoring unit drives the first controllable switch to be off when the LCD device sends the ON signal.

11. The liquid crystal display (LCD) device of claim 10, wherein the monitoring unit comprises a second controllable switch coupled to the ground end of the LCD device driver circuit, a divider resistor coupled to the second controllable switch, and a reference voltage coupled to the divider resistor; a control end of the second controllable switch is coupled to the starting signal;

wherein the OFF signal sent by the LCD device is a low-level signal, and the ON signal sent by the LCD device is a high-level signal; the first controllable switch and the second controllable switch are driven to turn on by the low-level signal.

12. The liquid crystal display (LCD) device of claim 10, wherein the monitoring unit comprises a divider resistor coupled to the ground end of the LCD device driver circuit, a second controllable switch coupled to the divider resistor, and a reference voltage coupled to the second controllable switch; a control end of the second controllable switch is coupled to the starting signal;

wherein the OFF signal sent by the LCD device is a low-level signal, and the ON signal output by the LCD device is a high-level signal; the first controllable switch is driven to turn on by the low-level signal, and the second controllable switch is driven to turn on by the high-level signal.

13. The liquid crystal display (LCD) device of claim 10, wherein the monitoring unit comprises a divider resistor coupled to the ground end of the LCD device driver circuit, a second controllable switch coupled to the divider resistor, and a reference voltage coupled to the second controllable switch; a control end of the second controllable switch is coupled to the starting signal by a logic inverter;

wherein the OFF signal sent by the LCD device is a low-level signal, and the ON signal sent by the LCD device is a high-level signal; the first controllable switch and the second controllable switch are driven to turn on by the high-level signal.

14. The liquid crystal display (LCD) device of claim 9, wherein resistance value of the discharge resistor is 100 KΩ.

* * * * *